US006622960B2

(12) United States Patent
Hyde

(10) Patent No.: US 6,622,960 B2
(45) Date of Patent: Sep. 23, 2003

(54) HOSE AND CABLE GUIDE

(76) Inventor: Warren L. Hyde, 363 Deerfield Rd., Candia, NH (US) 03034

( * ) Notice: Subject to any disclaimer, the term of this patent is extended or adjusted under 35 U.S.C. 154(b) by 48 days.

(21) Appl. No.: 09/925,876

(22) Filed: Aug. 8, 2001

(65) Prior Publication Data

US 2003/0029963 A1 Feb. 13, 2003

(51) Int. Cl.[7] ..... B65H 57/02; B05C 11/00

(52) U.S. Cl. ..... 242/615; 137/377; 188/32; 248/75

(58) Field of Search ..... 242/615; 137/377, 137/343; 188/32; 248/75, 76

(56) References Cited

U.S. PATENT DOCUMENTS 3,664,466 A * 5/1972 Rotheiser ..... 188/32
4,404,925 A 9/1983 Louwsma ..... 118/506
4,582,176 A * 4/1986 Roberts ..... 188/32
4,836,432 A 6/1989 Violette ..... 242/615
4,884,664 A * 12/1989 Berg ..... 188/32
4,895,225 A 1/1990 Parnell ..... 188/32
5,069,311 A * 12/1991 Young ..... 188/32
5,427,339 A * 6/1995 Pauli et al. ..... 248/75

* cited by examiner

*Primary Examiner*—John M. Jillions

(57) ABSTRACT

The present invention is directed to a device and method for preventing hoses, cords and cables from becoming jammed under wheels without impairing productivity nor leading to back strain. The device is comprised of a "U" shaped wedge body with a thin end and a thick end connected by equal top and bottom surfaces and a flat edge that wraps around the "U" shape to be wedged between the supporting surface and the tire tread. The outer expanding edge provides a contact surface for a hose or cable to be guided around the corner of the wheel. The top and bottom surfaces being equal making the device symmetrical and allowing the device to be equally effective when inserted either side up. The body provides a device that can be traversed, not removed, while the wheeled vehicle is being removed from the service area.

14 Claims, 6 Drawing Sheets

HOSE AND CABLE GUIDE

FIELD OF INVENTION

The present invention is directed to a mechanical device and method useful for preventing hoses, cords and cables from becoming jammed under vehicle tires without impairing productivity nor leading to back strain.

BACKGROUND OF THE INVENTION

The concept of having a device for preventing hoses, cables and the like from becoming jammed under vehicle tires during repairs or service has been disclosed in several U.S. Patents. In many applications involving work on a vehicle with tires, it is necessary for service personnel to pull a utility hose or cord from one side of the vehicle to another. There is a tendency for the hose to become wedged between the tire and the surface on which the tire is resting. This area has been referred to as the nip area (see for example U.S. Pat. No. 4,895,225 to Parnell).

For example, when servicing a vehicle, several different types of hoses such as lubrication or air hoses for pneumatic wrenches or electrical cables such as for electronic test equipment are pulled around the corners of the vehicle. During automobile painting, a similar rubber hose is pulled around the corners of the vehicle. Another common experience for the average automobile owner is pulling a water hose around the corners of the vehicle while washing the car. In all these instances, the hose easily becomes caught in the nip area between the rubber tread surface of the tire and the supporting surface such as the garage floor or driveway. Normally, once caught in the nip area, the hose cannot be pulled any further. It must be pulled back around the corner in the opposite direction until it can be freed. Having to walk back around the vehicle to free the hose from the nip can be very aggravating non-productive activity. To address this problem, Louwsma in U.S. Pat. No. 4,404,925 proposed filling the nip area between the tire and the working surface, using a device that has a wedge-shaped profile that can be placed in the nip area and that also has a vertical surface around which a painter's air hose can run and has a means for "receiving a finger" to manipulate the hose guide. In fact, this design is such that it has to be removed when servicing is complete. It cannot be driven over repeatedly without sustaining damage to the device, rendering it unusable. The device of the Louwsma invention has minimal contact area of the guide contacting the supporting surface and the tread surface of the tire. This could result in the device becoming dislodged when exposed to high stress such as when a high-pressure water hose is used.

The hose guide disclosed by Violette in U.S. Pat. No. 4,836,432 (Jun. 6, 1989 Class 242/615) is also designed for use with an automotive vehicle paint spray apparatus and is comprised of a U-shaped body having legs that embrace the tire at the ground level and that has an upward turned concave surface across which the hose may run. This device as does Louwsma's has a means to easily grasp it for adjustment and/or removal when finished. It is not designed to be driven over as a standard operating procedure. A further aspect of the Violette device is that any given device is limited in the range of tire widths with which it can be used. The Violette patent teaches that typically a device is used in front of both front tires and behind both rear tires.

The device of Parnell in U.S. Pat. No. 4,895,225 (Jan. 23, 1990 Class 188/32) for a "cylindrical hose guide wheel chock" discloses a wedge formed from a cylinder that is vertically placed under a tire. The function is two-fold, as a chock to prevent vehicle forward movement and to prevent a hose from becoming caught in the nip.

In none of the foregoing disclosures is there consideration of the disadvantage of personnel having to take extra time and effort to remove devices prior to moving the vehicle. It is the inventor's contention that this oversight has contributed to the lack of ready acceptance in the trade and by the consumer.

The invention in this application overcomes this and other disadvantages of the previous inventions.

SUMMARY OF THE INVENTION

Often various hoses, cables or electrical cords are used by service personnel and individuals servicing or maintaining their own vehicles. These hoses, cables or cords often times become lodged in a nip area between tire tread and the supporting surface when they are pulled around the corners of vehicles and through the nip area. Freeing up the hoses causes wasted time and effort for the service person who needs to backtrack and free the captured hose or cable.

The present invention is directed to mechanical device and method useful for preventing hoses and cable from becoming jammed under vehicle tires. The device is inserted in the gap (nip) between the tire tread of a tire and the supporting surface.

The preferred device is generally wedge-shaped in such a fashion and dimensions so as to fill the space between ground and tread in such a manner that no crevices are formed that could entrap a nominally sized hose or cable.

Another object of the device is that it be shaped and textured so that it will not be readily dislodged by the movement of the hoses or cables. To accomplish this purpose, the hose guide may have top and bottom surfaces that have a series of ridges and grooves designed to engage the respective surfaces and lodge the device firmly in place.

Another object is to provide a hose guide that has the size, shape and structural integrity that will allow it to be repeatably driven over by a vehicle.

Another object is to provide a hose guide that has symmetrical top and bottom surfaces allowing the guide to be inserted into the gap (nip) with different orientations without effecting functionality.

The method for preventing the jamming of the hoses under a wheel is to drop a wedge shaped device under the wheel in question and to kick it into place. Likewise it can be kicked clear when finished and/or driven over and kicked out of the way until further use.

The preferred method is to insert devices under each of the tires. This does not significantly slow down the servicing since it is not necessary to remove the devices when finished. One merely drives over them.

Since the service personnel do not need to bend down to dislodge the wedge, possible back strain or injury is avoided.

Another objective is to provide a device that can be readily and economically manufactured.

These and other objects of the present invention will become more readily appreciated and understood from a consideration of the following detailed description of the preferred embodiments when taken together with the accompanying drawings.

DETAILED DESCRIPTION OF THE PREFERRED EMBODIMENT

The present invention is a device and its method of use that prevents jamming of hoses, cords or cables and the like from under vehicle tires and which reduces the likelihood of back strains or injuries. The device is further described by explanation of the accompanying figures.

Figure 1:
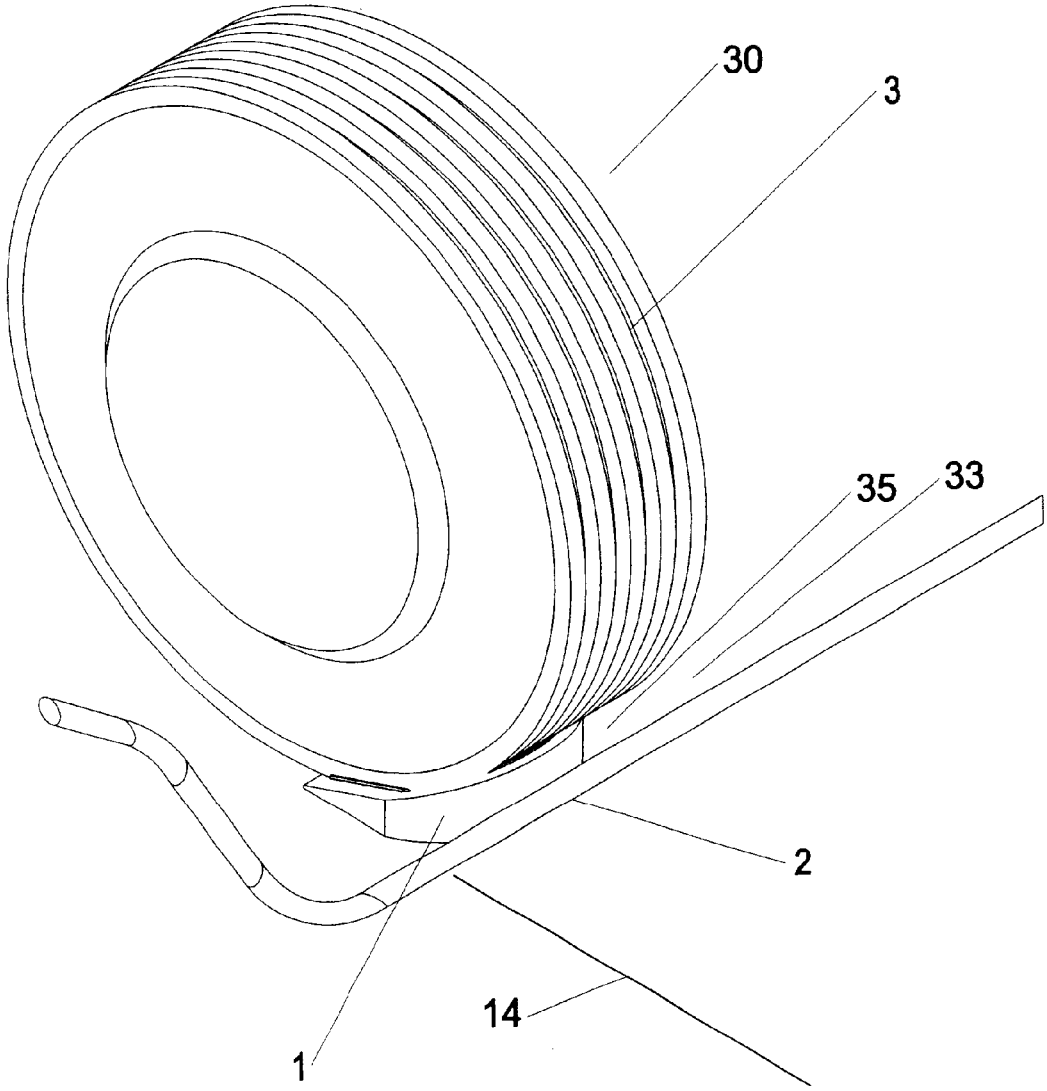
FIG. 1 is a perspective view of a preferred embodiment of the device being used in the presence of a hose, cord or cable.

FIG. 1 is a perspective view that illustrates a tire 30 resting on surface 14 such as a driveway or garage floor. There is a gap 33 between the tread 3 and the surface 14 at all but the very bottom of the tire. Into the gap 33 is inserted the device 1 so as to close the gap so that hose or cable 2 cannot be wedged into any gaps or openings pre-existing or created thereby. Specifically, the new gap 35 between the top of the uppermost edge of the device and the tire tread directly above shall be less than the diameter of the hose, cable or cord 2. This could mean the gap should be no greater than half an inch under anticipated usages. This requirement may be met in part by careful selection of the shape and dimensions of the device and in part by selection of a material that at least partially flexes under pressure to conform to the curvature of the tire and further by selection of material and shapes that lend themselves to a cord running over the surface with minimal friction.

Figure 2:
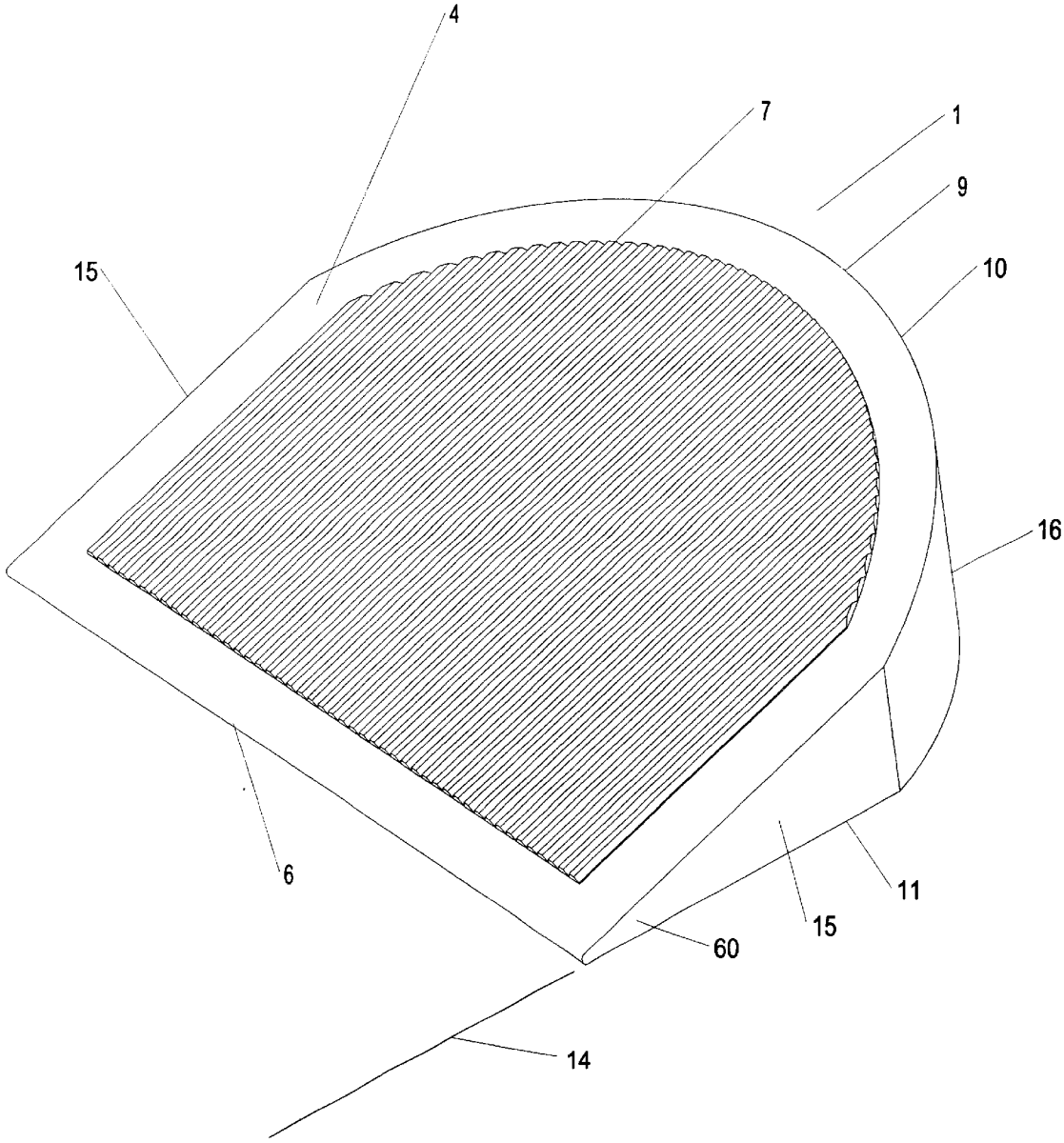
FIG. 2 is a top perspective view.
Figure 3:
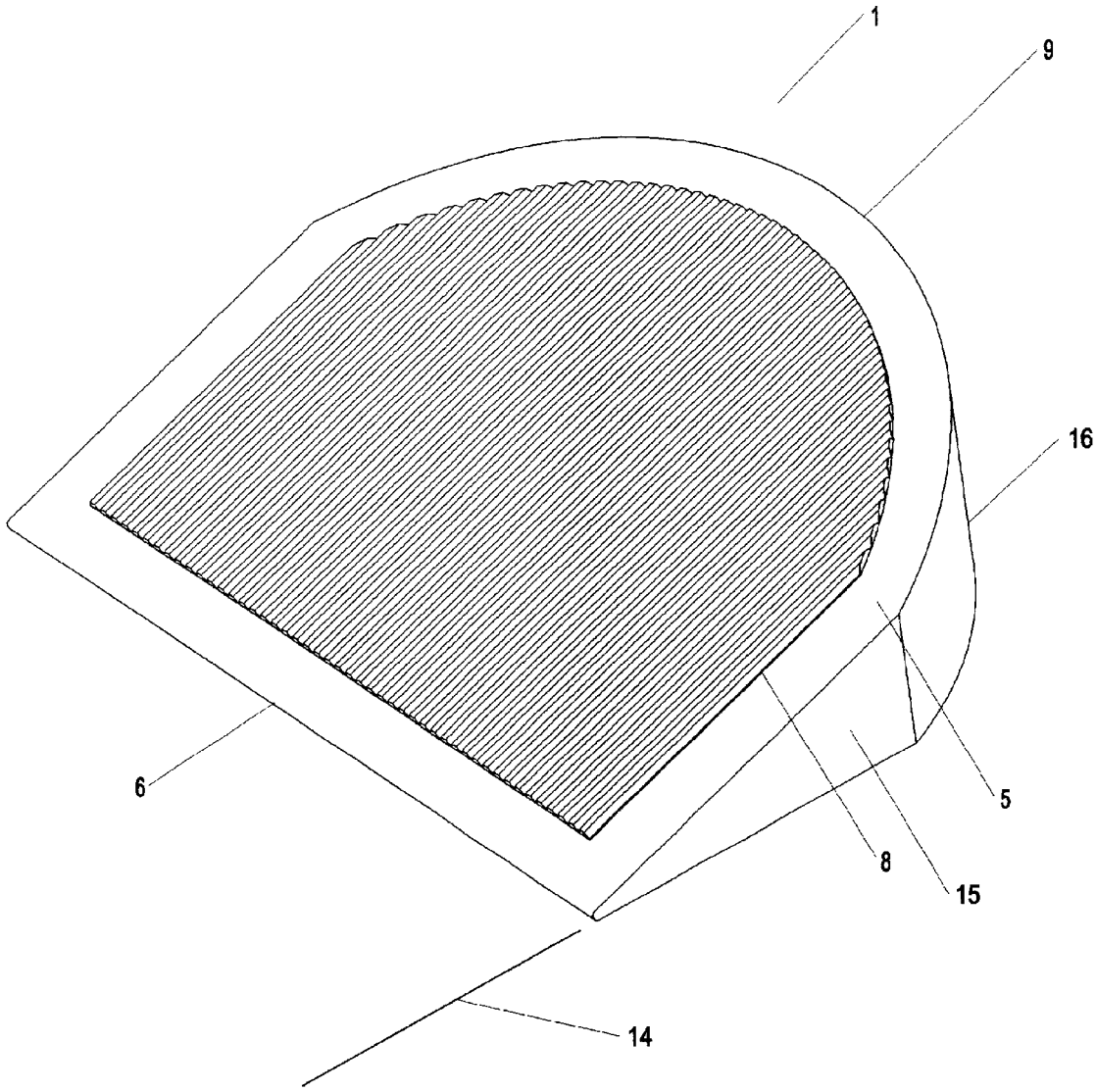
FIG. 3 is a bottom perspective view.

Referring now in more detail to the hose guide the device 1 is from top and bottom perspective views in FIGS. 2 and 3. The device 1 is generally in the form of a U-shaped wedge having a top flat surface 4, a flat bottom surface 5, which form an angle 60 at their intersection 6 that lies in the range of 15–60 degrees. The sides 15 and back 16 conform generally to a "U"-shaped outer surface connection top and bottom surfaces 4 and 5 at junctures 10 and 11. In a preferred embodiment this surface rises from the ground surface 14 in a nearly perpendicular direction. In actuality it may deviate from perpendicularity by as much as 30 degrees in the instance in which symmetry is designed for (that is the top 4 or bottom 5 surfaces can be used interchangeably). One advantage of a symmetrical design is ease of manufacturing. Another advantage is ease of use—you can drop the device on the floor and kick it into place without regard for orientation.

The function of the "U"-shaped surface is to provide a curved surface over which the hose or cable 2 may traverse without any impediments and without the need for perfect alignment under a tire. It is important that the dimensions of the side 15 of the device be sufficiently large and the width of the "U" sufficiently broad so that a hose is prevented from catching a corner of the tire not covered by the device. In the preferred embodiment such dimensions are on the order of 3–6 inches on the side 15 by 4–6 inches between the sides. Additionally, the width of the wedge end surface 9 (in FIG. 4) is at least as wide as the largest hose or cable diameter (1 inch) but no wider than practical for one to easily drive over (2 inches).

Note that the device could be made smaller to work with e.g. compressors that are on wheels, so hoses do not get caught in compressor wheels. Typically the tires for such appliances are less that 12 inches diameter and less than 4 inches wide. Thus, a hose guide device could be 3–4 inches on the side, only 3–4 inches between sides and between 1–2 inches maximum thickness and still be effective in this application.

Advantageously the top surface 4 in FIG. 2 and bottom surface 5 in FIG. 3, though substantially flat surfaces have a series of ridges and grooves 7 and 8 respectively traversing the surfaces from the point of the wedge 6 to the thick part of the wedge end surface 9. The dimensions of such grooves are preferably 1–5 mm deep and 1–5 wide.

In one embodiment, top surface 4 and bottom surface 5 are equal in length and width, creating a symmetrical device.

An alternative surface treatment is to provide a granularity over the entirety of both surfaces 4 and 5. Such granularity might be molded in, incorporated near the end of curing or applied as a separate operation in manufacturing whichever is most cost effective and provides functional stability during extended use.

When used in the expected application the hose guide 1 is placed in the gap (nip) area as shown in FIG. 1, where the tire tread 3 of a wheeled vehicle meets the supporting surface 14. The hose guide 1, fills this gap. Ridges and grooves 7 in the top surface 4 as seen in FIG. 2. (or granularity as suggested above) contacts the supporting surface 14, causing the guide 1 to be firmly lodged in the gap area preventing the guide 1 from becoming dislodged as the hose or cables 2, are pulled around the corner of the wheeled vehicle being serviced.

Figure 4:
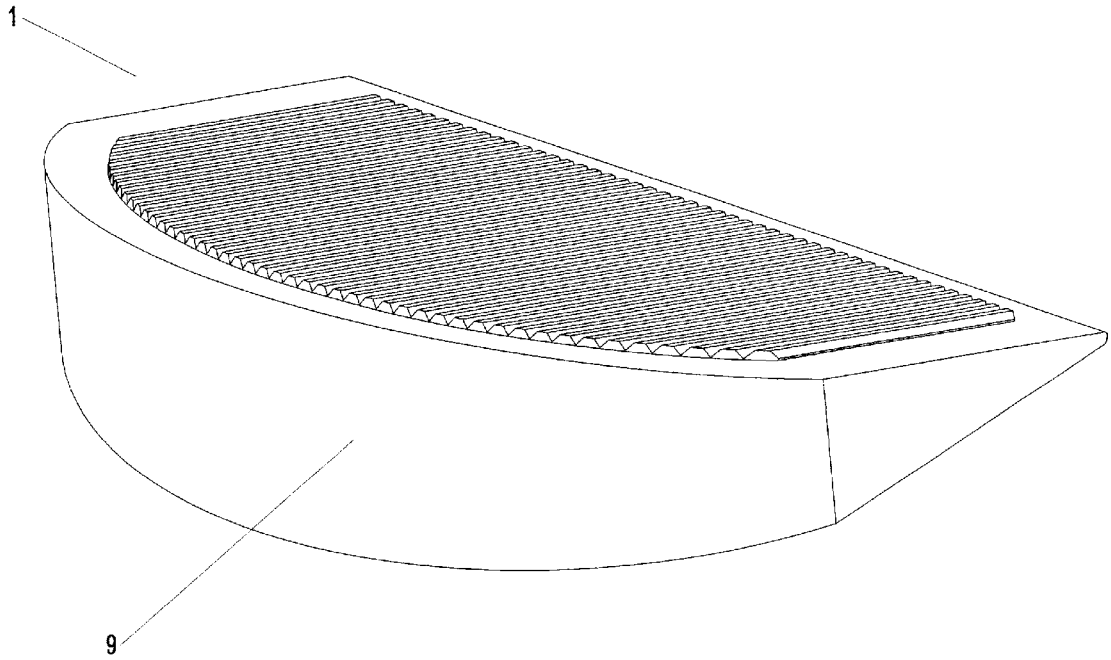
FIG. 4 is a front perspective view.

FIG. 4 provides a front perspective view of the device 1 illustrating more completely the shape of the front surface 9 of the wedge.

Figure 5A:
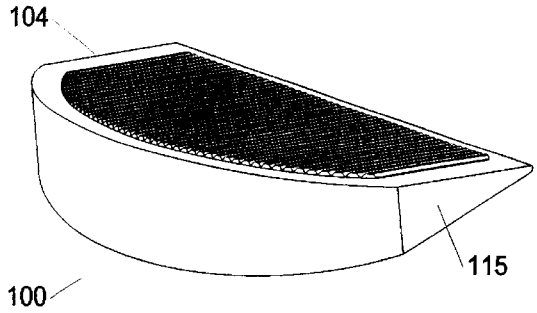
FIG. 5*a* is a side perspective view of a non-solid embodiment.

One principal design requirement of the present embodiment of the hose and cable guide is a body structure that can be molded partly and that can withstand the weight of a vehicle traversing the guide 1, when the vehicle being serviced is removed from the service area. While FIGS. 2 and 3 would indicate that the preferred embodiment is a solid wedge-shaped device, it is possible that the same goals would be met with a non-solid-wedge-shaped device as illustrated in FIGS. 5*a* and 5*b* and 5*c* and 5*d*. In FIG. 5*a*, a perspective view is provided showing the device 100 being of a general wedge shape but integrally providing a plurality of struts or ribs to enable it to be molded and to be formed in a unitary operation. These ribs are provided in a selected number and location relative to the size of the guide to provide substantial strength to support the weigh of a portion of wheeled vehicle.

Figure 5B:
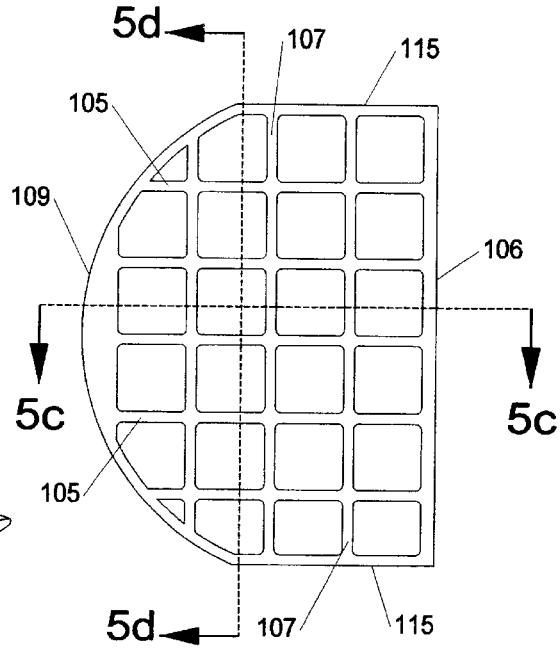
FIG. 5*b* is a detailed bottom view of a non-solid embodiment.
Figure 5C:
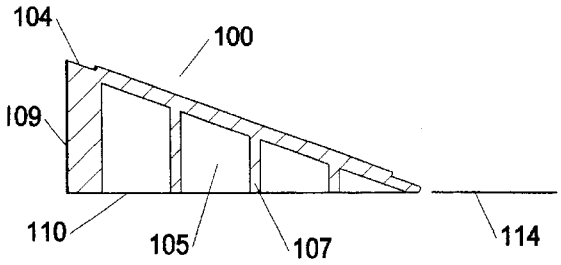
FIG. 5*c* is a cross-sectional side view of a non-solid embodiment.
Figure 5D:
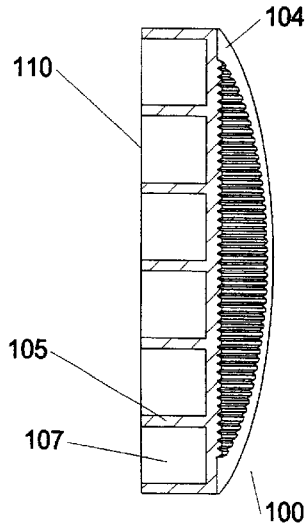
FIG. 5*d* is a cross-sectional end, from the thin end of the wedge looking to the thick end, view of a non-solid embodiment.

FIG. 5*b* illustrates a plurality of vertically disposed longitudinally extending ribs 107 (three as shown) and which extend from one end 106 of the wedge shape to the other thick end 109. A similar set of 5 longitudinally extending ribs 105 extending from one of the side walls 115 to the traverse side walls 115, as also shown in FIGS. 5*c* and 5*d*. In order to promote good flow ability in an injected molded part wall thicknesses of no more than ⅛ inch are recommended. The advantages of this embodiment are lower costs and lighter weight.

Furthermore, these longitudinally extending ribs and the transversely extending ribs extend downwardly in a vertical direction creating columns of open area to the overall depth of the guide 100. Thus all the ribs extend from the interiorly presented surface of the top surface 104 and they all have their lower edges aligned to a common horizontal plane.

This embodiment may be implemented by forming a mold suitable for use in plastic injection molding machines wherein there are interleaving parts to alternately form ribs and pockets, side surfaces and a top surface to form the thin and thick parts of the wedge wherein said thick part is cured to approximate the bottom of a "U"; feeder channels through which thermoplastic resin is forced under high pressure; and knockout pins provided to push the completed part from the mold.

Materials that would be appropriate for the solid embodiment include wood, hard rubber and moldable plastics. Materials that would be appropriate for the non-solid embodiment include lightweight castable metals such as aluminum and injection moldable thermoplastics such as high impact styrene, epoxy resins, glass fiber reinforced resins and the like. Besides durability and strength, materials shall be selected based upon their potential to conform to the shape of the tire and slipperiness of the surfaces that would come into contact with the hoses or cables.

Figure 6:
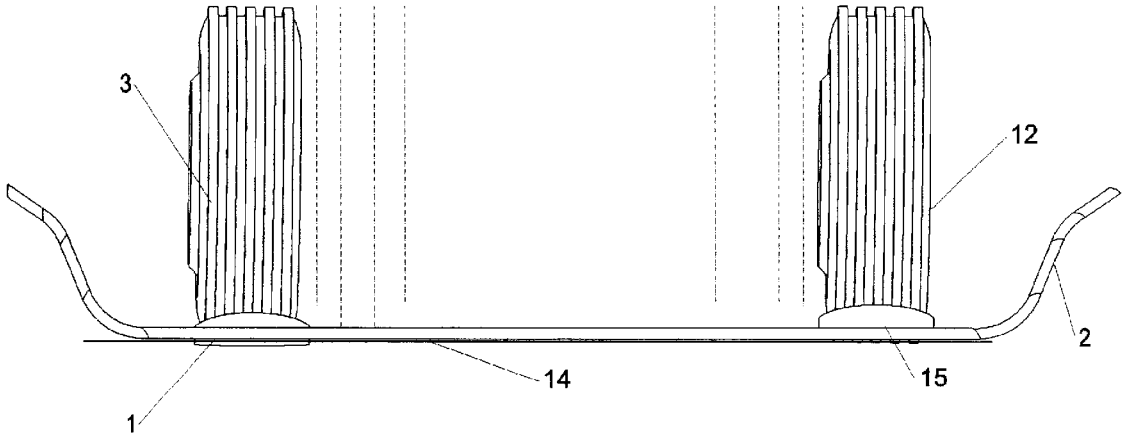
FIG. 6 is a front view elevation showing two hose guides being used.

FIG. 6 is a front view elevation that illustrates the use of two hose guide devices 1 and 15, when placed on the outside of the tire tread 3 and 12 respectively. Also shown are phantom lines depicting varying widths of tires, illustrating the potential effectiveness of the devices even for use with very wide tires as long as the guides are placed near the outside of the tire tread surface.

The method of use entails dropping or placing one ore more devices on the floor 14 and pushing them into place under the tire to fill the nip. This can be done by using one's feet or hands equally conveniently. The design of the device is such that if dropped to the floor it will assume the proper position necessary to slide it under the tire since either way it falls, it will work. Furthermore, the device is designed so that it can be run over so it is easy to pick up or sweep to the side when the vehicle is removed from the service area. This methodology tends to reduce back strain and/or finger injuries.

Accordingly, the present invention has been described with some degree of particularity directed to preferred embodiments of the present invention and methods of use. It should be appreciated, though, that the present invention is defined by the following claims construed in light of the related art so that modifications or changes may be made to preferred embodiments of the present invention without departing from inventive concepts contained herein.

I claim:

1. A mechanical device for use with wheeled items to prevent hoses, cords, cables and the like from being caught in a nip area between a lower supporting surface and an upper tread surface of said wheeled items when said hoses, cords or cables are pulled around said wheels comprising:

a wedge-shaped body having a substantially flat bottom base to engage the lower supporting surface and a top surface at an angle to the bottom base so as to provide contact with the wheel tread at least one inch above the lower supporting surface;

said wedge-shaped body having three sides that follow the shape of a "U", the rounded shoulders of which provide a smooth surface over which hoses and the like can be pulled;

said wedge-shaped body having a fourth side formed by the intersection of the top surface and bottom surface that may be thrust under a wheel;

said wedge-shaped body having at the bottom end of the "U" shape a thickness sufficient to fill said nip area and provide a vertical surface greater than the diameter of hoses and cables;

said wedge-shaped body having a wedge width sufficient to be stable on the said supporting surface; and, said wedge-shaped body having a maximum thickness at the base of the "U" so that it can easily be run over by the wheel.

2. The device of claim 1 wherein said wedge-shaped body is further comprised of a series of grooves and ridges in the said top surface and flat bottom base running perpendicular to the thin end of the wedge-shaped body to minimize sideways movement.

3. The device of claim 1 wherein either or both of the flat bottom base or top surface is further comprised of a textured surface.

4. The device of claim 1 wherein said angle between the top and bottom surfaces is between 15 and 60 degrees.

5. The device of claim 2 wherein said grooves and ridges are between 1 and 5 mm deep and between 1 and 5 mm wide.

6. The device of claim 1 wherein said top and bottom surfaces are identical and the angles between either of the top or botton surfaces and the vertical surface at the thick end are equal allowing for inter-changeability.

7. The device of claim 1 wherein said wedge-shaped body is solid.

8. The device of claim 7 wherein said solid is comprised of a hard rubber, wood, metal, high strength plastics to withstand the weight of a wheeled item such as a vehicle when said device is traversed by said wheeled vehicle during removal from the work area.

9. The device of claim 1 wherein said maximum thickness at the base of the "U" of the wedge-shaped body is two inches.

10. The device of claim 1 wherein said wedge-shaped body is not solid but rather is further comprised of a solid top and side surfaces with struts or ribs on the interior creating open columns so as to reduce the amount of materials used and weight of the device without changing the over-all boundary shape or function.

11. The device of claim 10 wherein said body is made of a moldable plastic or castable metal that would be able to withstand the weight of a wheeled vehicle when said device is traversed by said wheeled items during removal from the work area.

12. The device of claim 11 wherein the moldable plastic includes one or more of high impact styrene, epoxy resins, and glass fiber reinforced resins.

13. A method for using devices with wheeled items to prevent hoses, cords, cables and the like from being caught in a nip area between a lower supporting surface and an upper tread surface of said wheeled items when said hoses, cords or cables are pulled around said wheels comprising use of one or more interchangeable devices comprising:

providing a wedge-shaped body having a substantially flat bottom base to engage the supporting surface and a tip surface at an angle to the bottom base so as to provide contact with the wheel tread at lease one inch above the lower supporting surface;

providing said wedge-shaped body with three sides that follow the shape of a "U", the rounded shoulders of which provide a smooth surface over which hoses and the like can be pulled;

providing said wedge-shaped body with a fourth side formed by the intersection of the top surface and bottom surface that may be thrust under a wheel as with one's foot;

providing said wedge-shaped body with, at the bottom end of the "U" shape, a thickness sufficient to fill said nip area and provide a vertical surface greater than the diameter of hoses and cables;

providing said wedge-shaped body with a wedge width sufficient to be stable on the said supporting surface; and, providing said wedge-shaped body with a maximum thickness of two inches at the base of the "U" so that it can easily be run over by the wheel for ease of removal.

14. The method of claim 13 further providing said wedge-shaped with a series of grooves and ridges in the said top surface and flat bottom base running perpendicular to the thin end of the wedge-shaped body to minimize sideways movement.

* * * * *